United States Patent [19]

Koiso et al.

[11] 4,279,454

[45] Jul. 21, 1981

[54] CABINET WITH FOLDABLE SLIDING DOORS

[75] Inventors: Kazuhiro Koiso, Katano; Masaaki Sanda, Hirakata; Mamoru Hayashi, Katano; Hiroaki Uesugi, Hirakata, all of Japan

[73] Assignee: Matsushita Electric Industrial Co., Ltd., Osaka, Japan

[21] Appl. No.: 72,582

[22] Filed: Sep. 5, 1979

[30] Foreign Application Priority Data

Sep. 8, 1978 [JP] Japan ..... 53/124298[U]
Sep. 8, 1978 [JP] Japan ..... 53/124299[U]

[51] Int. Cl.[3] ..... E06B 9/14

[52] U.S. Cl. ..... 312/297; 160/196 R; 160/206; 312/199; 312/307

[58] Field of Search ..... 160/196 R, 196 D, 206, 160/199; 312/297, 304, 324, 307

[56] References Cited

U.S. PATENT DOCUMENTS

| | | | |
|---|---|---|---|
| 2,168,022 | 8/1939 | Drager | 312/297 |
| 3,110,533 | 11/1963 | Le Bron | 312/297 |
| 3,491,400 | 1/1970 | Hubbard | 160/206 |

*Primary Examiner*—Casmir A. Nunberg
*Attorney, Agent, or Firm*—Spencer & Kaye

[57] ABSTRACT

A cabinet comprising a cabinet body, a rail continuously laid in the cabinet body, and a glass doors each of which consists of a plurality of glass strips foldably connected together. The glass doors are retracted into or withdrawn from the cabinet body while slidingly moving the glass doors such that they are folded along the rail, to open or close the whole of the front side of the cabinet body. A cabinet according to the present invention permits minimizing the space in which the glass doors are opened or closed, and opening the whole of the front side of the cabinet body.

8 Claims, 10 Drawing Figures

CABINET WITH FOLDABLE SLIDING DOORS

BACKGROUND OF THE INVENTION

1. Field of the Invention

The present invention relates to a cabinet comprisng a cabinet body opened at the front side thereof, and foldable glass doors slidably installed in the cabinet body.

2. DESCRIPTION OF THE PRIOR ART

A cabinet which has heretofore been used as a piece of furniture or an audio-rack consists of a cabinet body, and a transparent glass door movably covering the front side of the cabinet body. Many conventional cabinets of this kind have one or two glass doors which are rotatably secured to a cabinet and which can be rotated outwardly to open the front side of the cabinet, or two glass doors placed on linear rails laid on the front edge portion of the top and the bottom walls of the cabinet body, which can be slidingly moved to right and left to open the right half portion or left half portion of the front side of the cabinet body.

When a rotatable glass door as mentioned above has been opened, it is projected to a great extent from the front side of the cabinet. Therefore, it is necessary that a cabinet having such a glass door be arranged in a place which permits leaving a sufficiently large space in front of the cabinet. In the meantime, even when either one of two doors placed on two rails as mentioned above has been fully opened, a half of the front side of the cabinet is covered with the doors. Therefore, a cabinet having such slidingly movable doors is troublesome for inserting articles thereinto and withdrawing the same therefrom.

SUMMARY OF THE INVENTION

An object of the present invention is to provide a cabinet which is free from problems constituting the drawbacks encountered in conventional cabinets.

Another object of the present invention is to provide a cabinet comprising a cabinet body, and glass doors each of which consists of a plurality of glass strips foldably connected together, which glass doors can be slidingly moved, while they are being folded, from the front portion of the cabinet body to the side portions thereof so that the whole of the front side of the cabinet body can be opened without outwardly projecting the glass doors from the front side of the cabinet body.

Still another object of the present invention is to connect a plurality of glass strips, which form a door of a cabinet, to one another very easily by flexible belts such that the connected glass strips can be folded.

A further object of the present invention is to instantaneously attach a plurality of fixing elements to a plurality of glass strips which form a door of a cabinet.

A still further object of the present invention is to provide rollers under the above mentioned fixing elements so that a heavy-weight glass door can be easily moved owing to the rollers which roll along or in the vicinity of a rail laid in a cabinet body.

A still further object of the present invention is to attach to an end portion of each of the mentioned glass strips a fixing element composed of a resin and having first and second hinges integrally formed therewith, which first and second hinges are rotatably connected to second and first hinges of the adjacent fixing element so that a plurality of glass strips are foldably connected together.

To these ends, the present invention provides a cabint having a cabinet body opened at the front side thereof, glass doors each of which consists of a plurality of glass strips foldably connected together, rails which are laid in the cabinet body to allow the glass doors to be slidingly moved thereon and which are extended from the front portion of the cabinet body to side portion thereof, and flexible belts pasted on the inner surfaces of the glass strips to thereby foldably connect the glass strips together.

The above and other objects as well as the advantageous features of the invention will become clear from the following description of preferred embodiments taken in conjunction with the accompanying drawings.

Figure 1:
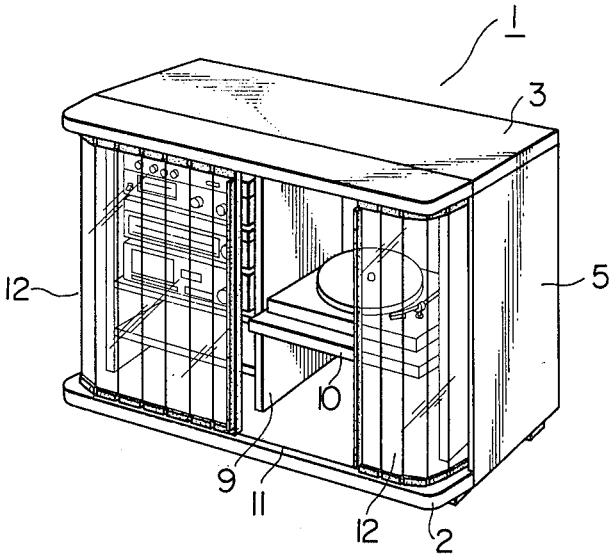
FIG. 1 is a perspective view of a first embodiment of the present invention.

DESCRIPTION OF THE PREFERRED EMBODIMENTS:

A first embodiment of the present invention, which is used as an audio-rack for housing parts of a component type audio appliance, will be described with reference to FIGS. 1–7.

Referring to FIGS. 1–7, reference numeral 1 denotes a cabinet body, 2 a bottom wall, 3 a top wall, 4, 5 side walls, 6 a rear wall set up on that portion of the upper surface of the bottom wall 2 which is slightly distant from the rear edge of the bottom wall 7, 8 right and left partition walls, 9 a central partition wall, and 10 a plurality of shelves provided between the partition walls 7, 8, 9 for placing thereon parts of an audio appliance, such as a record player, a tuner, an amplifier and tape recorders.

Figure 3:
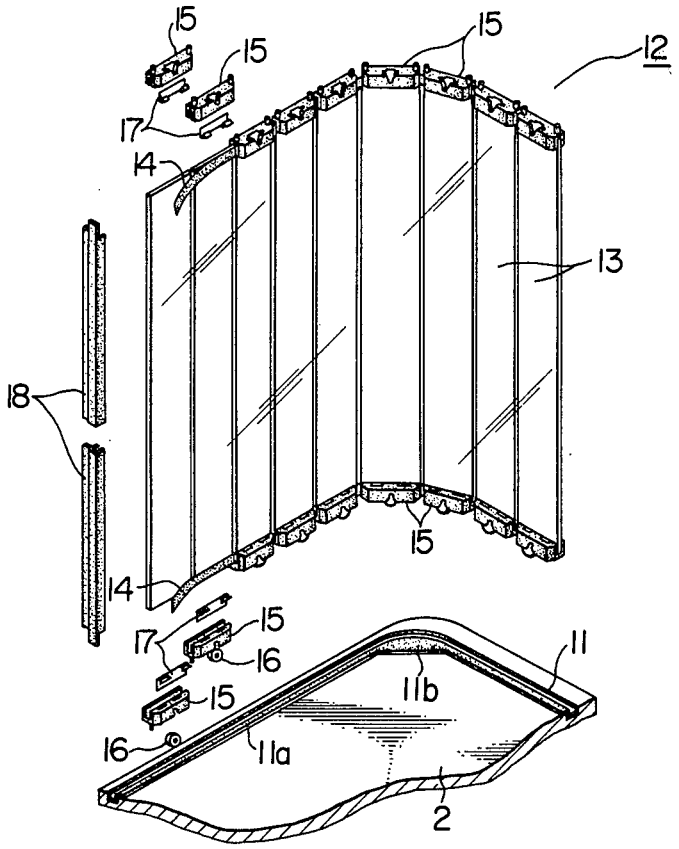
FIG. 3 is an exploded view in perspective of a principal portion of the embodiment shown in FIG. 1.

A substantially cross-sectionally U-shaped raill 11 made of resin, such as a hard vinyl chloride, polyamide, or polypropylene is embedded in the upper surface of the whole of the peripheral portion of the bottom wall 2. The rail 11 has a horizontal rib 11*a* inwardly extended from the upper end portion of the whole of the inner wall thereof as shown in FIG. 3. The rib 11*a* has corner portions 11*b* which are broader than the remaining portions thereof. A similar rail (not shown) is embedded in the lower surface of the top wall 3.

Reference numeral 12 denotes glass doors each of which is produced by the following procedure.

Figure 4:
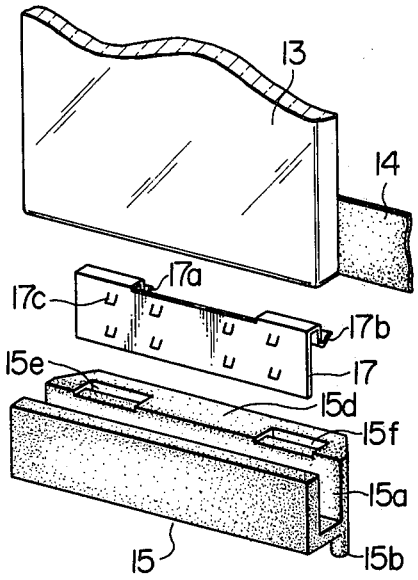
FIG. 4 is an enlarged exploded view in perspective of another principal portion of the embodiment shown in FIG. 1.
Figure 5:
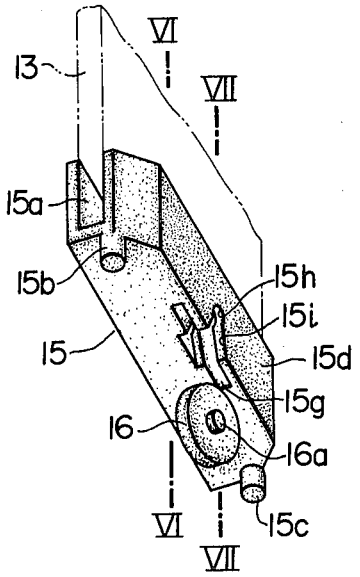
FIG. 5 is a perspective view of a fixing element with a roller of the embodiment shown in FIG. 1.

A plurality of reinforced transparent glass strips 13 are firstly arranged in the same plane. Flexible belts 14 made of polypropylene or polyamide are pasted with a pressure sensitive bonding agent or duplex tape on both end portions of the inner surfaces of the glass strips 13. The glass strips 13 thus connected together can be folded via the belts 14. Fixing or fastening elements 15 are then attached to the upper and lower end portions of each of the glass strips 13. Each of the fixing elements 15 is integrally made of acrylobutadiene styrole (ABS), nylon, polyacetal, or polypropylene, and provided as shown in FIGS. 4 and 5 with a groove 15*a* in the upper surface thereof and two pins 15*b*, 15*c* projected from the lower surface thereof. Engagement recesses 15*e*, 15*f* are provided in both end portions of the upper surface of a side wall 15*d* of the fixing element 15, and a roller holding recess 15*g* in the central portion of the lower surface of the side wall 15*d*. The roller holding recess 15*g* has cylindrical bores 15*h* in opposite surfaces defining the recess 15*g*, and guide passages 15*i* extended from the cylindrical bores 15*h* to the lower end of the recess 15*g* in the opposite surfaces as well. The width of the upper portion of the guide passage 15*i* which communicates with the cylindrical bore 15*h* is somewhat smaller than the diameter of the shaft 16*a* of a roller 16 which will be described later.

Figure 6:
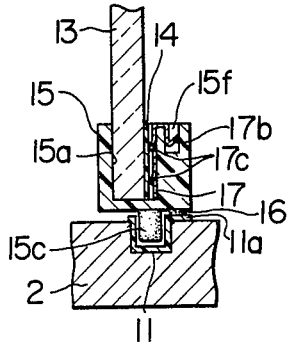
FIG. 6 is a sectional view taken along the line VI—VI in FIG. 5.

Reference numeral 17 denotes a metal piece used to instantaneously attach the fixing element 15 to the glass strip 13, and is made of a carbon steel plate or a stainless steel plate. The metal piece 17 has engagement portions 17*a*, 17*b* formed by bending the upper section thereof, and a plurality of engagement pawls 17*c* as shown in FIG. 6, which are formed by cutting and outwardly bending the main section thereof. The engagement portions 17*a*, 17*b* of the metal piece 17 are press-fitted in the engagement recesses 15*e*, 15*f* in the fixing element 15 so that the metal piece 17 is secured to the fixing element with the engagement pawls 17*c* being positioned within the groove 15*a*.

Figure 7:
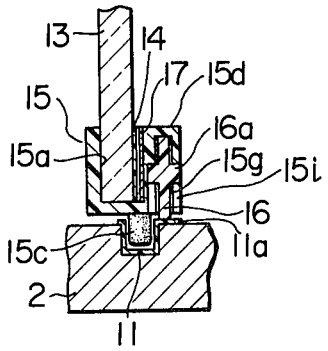
FIG. 7 is a sectional view taken along the line VII—VII in FIG. 5.

Reference numeral 16 denotes a roller for lightly sliding the large heavy-weight glass door 12. The roller 16 and its shaft 16*a* are integrally made of a resin, such as nylon, polypropylene, or polyacetal, and rotatably fixed in the roller holding recess 15*g* as shown in FIG. 7 by press-fitting both end portions of the shaft 16*a* in the cylindrical bore 15*h* via the guide passage 15*i*. Since the width of the upper portion of the guide passage 15*i*, which is communicated with the cylindrical bore 15*h*, is somewhat smaller than the diameter of the shaft as mentioned above, the shaft, if it has once been press-fitted in the cylindrical bore 15*h*, does not come off easily. When the end portion of the glass strip 13 is press-fitted into the groove 15*a* of the fixing element 15 after the roller 16 and metal piece 17 have been attached to the fixing element 15, the engagement pawls 17*c* of the metal piece 17 bites into the belt 14. The fixing element is then attached to each glass strip 13.

Handles 18 made of a resin are thereafter fitted on the side edge portion of the outermost glass strip 13 and secured thereto with a bonding agent or the like to obtain a flexible glass door 12.

Since the purpose of employing the rollers 16 is to receive the weight of the glass door 12, it is not strictly necessary, as may be noted from FIG. 3, to furnish those fixing elements 15 with rollers 16, which are fixed to the upper end portions of the glass plates 13.

The glass door 12 constructed as mentioned above is installed in the cabinet body 1 while inserting into the rail 11 the pins 15*b*, 15*c* of each of the fixing elements 15, so that the glass door 12 can be slidingly moved along the rail 11.

Figure 2:
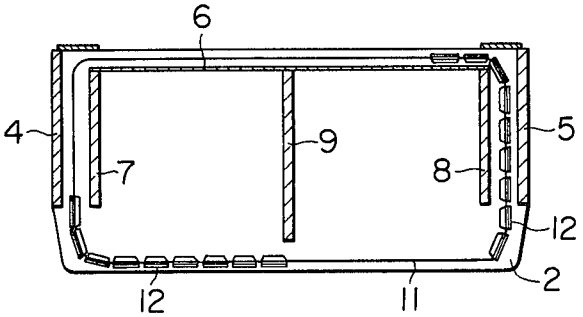
FIG. 2 is a top view in cross section of the embodiment shown in FIG. 1.

Two glass doors 12 are slidably set on the rail 11 in the above-described manner so that one of the glass doors 12 covers a half of the front side of the cabinet body 1 with the other covering the remaining half thereof as shown in FIGS. 1 and 2. When the glass doors 12, 12 are made to slide to the right and to the left, they are bent along the rail 11 from the front side of the cabinet body 1 to both sides of the cabinet body 1 which are at right angles to the front side thereof. When the glass doors 12, 12 are caused to slide further, the rear end portions thereof will be turned round the rear corners of the cabinet body 1 to reach the rear side thereof so that the glass doors 12 are in a fully opened state. While the glass doors 12 are slidingly moved, the rollers 16 set under the fixing elements attached to the lower end portions of the glass strips 13 are rolled on the rib 11*a* of the rail 11 as shown in FIGS. 6 and 7. Therefore, even a large and heavy-weight glass door will slide easily and lightly on the rail 11. Since the corner portions 11*b* of the rail 11 are formed wider than the remaining portions thereof, the rollers 16 never get off the corner portions 11*b* and therefore the glass doors 12 bend very smoothly.

In order to minimize the gap between the adjacent glass strips 13, 13 at the corner portions of the cabinet body 1, it is desired that the pins 15*b*, 15*c* of the fixing elements 15 be spaced from each other as much as possible in this embodiment.

According to the above embodiment, it is unnecessary, unlike a conventional cabinet having a rotary glass door, to provide a large space in front of the cabinet body. Moreover, the above embodiment permits the entire front side thereof to be opened, unlike a conventional cabinet having linearly slidable glass doors which cover a half of the front side thereof even when the glass doors are in a fully opened state. This allows the area of the space substantially occupied by the cabinet to be minimized. In addition, articles can be inserted in and withdrawn from the cabinet very easily.

According to the present invention, foldably connecting a plurality of glass strips 13, attaching fixing elements 15 to the glass strips 13, and setting rollers 16 under the fixing elements 15 can be carried out very easily. Consequently, a large glass door consisting of many glass strips can be assembled very easily.

If a glass door constructed as in the above embodiment, or in such a manner that the rear end portion thereof can be turned around the rear corner portions of the cabinet body to reach the rear side thereof is employed, the front side of the cabinet body, even when it has a large width and a small depth, can be fully opened or closed. A cabinet, the front side of which is covered with a plurality of reinforced glass strips, may look luxurious thereby increasing its commercial value. This may constitute an additional effect of the present invention.

Figure 8:
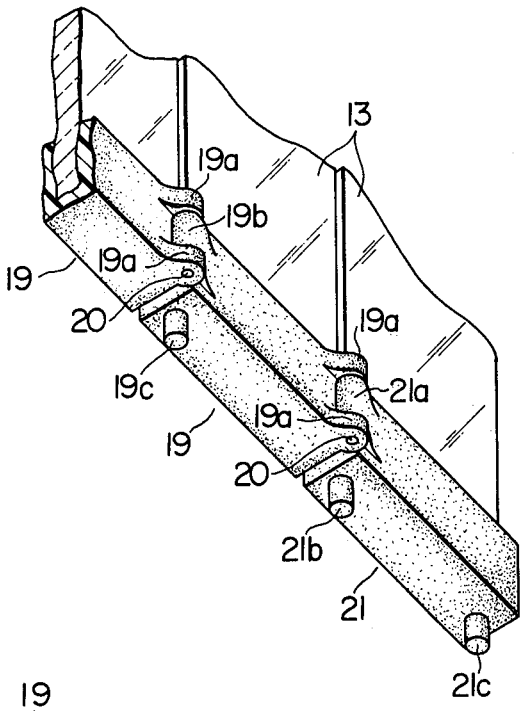
FIG. 8 is a perspective view of a principal portion of a second embodiment of the present invention.
Figure 9:
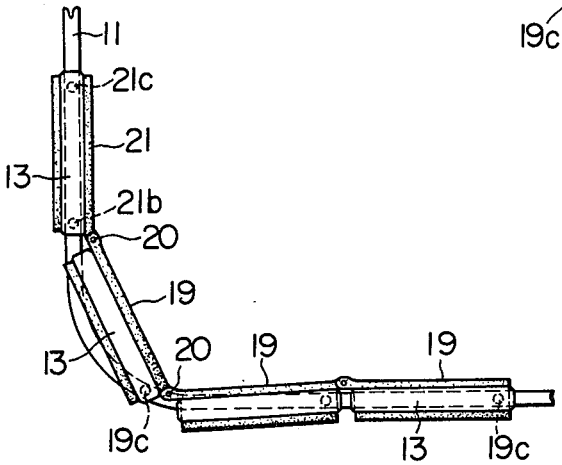
FIG. 9 is a top view in cross section of the principal portion shown in FIG. 8 of the second embodiment of the present invention.
Figure 10:
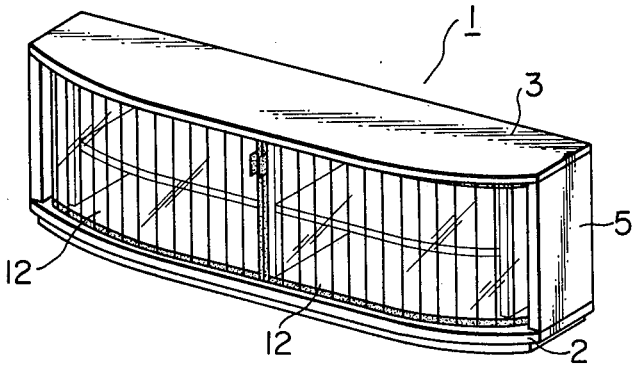
FIG. 10 is a perspective view of a third embodiment of the present invention.

FIGS. 8–9 and 10 show another embodiments having modified fixing elements.

Each of the fixing elements 19 of the embodiment shown in FIGS. 8–9 has at one end portion thereof a first hinge consisting of projections 19*a*, 19*a*, and at the other end portion thereof a second hinge consisting of a projection 19*b* which can be inserted into a space between projections 19*a*, 19*a* of the adjacent fixing element 19. The fixing element 19 also has a pin 19*c* on the lower surface thereof. The fixing element 19 having first and second hinges and pin 19*c* is integrally made of ABS, nylon, polyacetal, or polypropylene.

The fixing elements 19 are attached with a bonding agent or the like to the upper and lower end portions of each glass strip 13 in the following manner. The projections 19*a*, 19*a* and the projection 19*b* of the adjacent fixing elements 19 are aligned with one another, and a pin 20 is inserted into the projections 19*a*, 19*a*, 19*b*, which are thereby rotatably joined together.

A fixing element 21 attached to the outermost glass strip has a second hinge at one end portion thereof which consists of a projection 21*a*, and two pins 21*b*, 21*c* on the lower surface thereof. The projection 21*a* is rotatably connected in the same manner as mentioned above to projections 19*a*, 19*a* of an adjacent fixing element 19 with the pin 20. A plurality of glass strips may be foldably connected together in this manner as well to form a glass door.

The above is a description of a cabinet according to the present invention, which is used as an audiorack. However, a cabinet according to the present invention can also be used as a piece of furniture as shown in FIG. 10, or as a large case, such as a show window. Only one glass door need installed in the cabinet body to open the whole of the front side thereof by sliding the glass door.

The present invention is not, of course, limited to the above embodiments; it may be modified in various ways within the scope of the appended claims.

What is claimed is:

1. In a cabinet including:

a cabinet body having an open front portion, side portions and a rear portion;

a rail located within said cabinet body;

at least one glass door arranged to cover the open front portion of said cabinet body, said glass door comprising a plurality of glass strips aligned in juxtaposition with each other, each of said glass strips having opposing end portions and opposing side edge portions, the side edge portions of adjacent strips adjoining each other;

a flexible belt secured to the end portions of said glass strips, said flexible belt flexibly connecting adjacent glass strips to each other;

a fastening element attached to an end portion of at least one glass strip, said fastening element guiding said glass strips along said rail, the improvement wherein said fastening element comprises a pair of side walls having a groove therebetween for receiving an end portion of one of said glass strips together with said flexible belt, one of said side walls having at least one engagement recess in the top surface thereof, and a metal piece having a main section provided with engagement pawls on the surface thereof and at least one engagement section for tightly engaging the engagement recess in said one side wall, the main section of said metal piece being positioned between said one side wall and said flexible belt, said engagement pawls engaging said flexible belt and thereby holding the end portion of said glass strip within said groove.

2. A cabinet according to claim 1, wherein said rail extends continuously from the front portion of said cabinet body to the side portions thereof and then to the rear portion thereof.

3. A cabinet according to claim 1 or 2, wherein said fastening element is provided with a roller for rolling on said rail, said roller being further provided with a shaft portion.

4. A cabinet according to claim 3, wherein said fastening element has a roller holding recess in one of said opposite walls, said roller holding recess having opposite surfaces and an opening, a cylindrical bore provided in each of said opposite surfaces to rotatably support therein the shaft portion of said roller, and a guide passage having a narrow section extending from said cylindrical bore to said opening, the width of said narrow section being smaller than the diameter of the shaft portion of said roller, thereby press-fitting the shaft portion of said roller into said cylindrical bore via said guide passage so as to rotatably support said roller in said roller holding recess.

5. A cabinet according to claim 1, wherein said fastening element further comprises at least one pin projecting from one side of said element remote from said groove, said pin connecting said guiding element to said rail.

6. A cabinet according to claim 1, wherein said fastening element is provided with two longitudinally spaced pins.

7. A cabinet according to claim 1 wherein said flexible belt is secured to said glass strips by paste.

8. In a cabinet including:

a cabinet body having an open front portion;

a rail located within said cabinet body;

at least one glass door arranged to cover the open front portion of said cabinet body, said glass door comprising a plurality of glass strips aligned in juxtaposition with each other, each of said glass strips having opposing end portions and opposing side edge portions, the side edge portions of adjacent strips adjoining each other;

flexible belts secured to the end portions of said glass strips, said flexible belts flexibly connecting adjacent glass strips to each other; and fastening elements attached to each of the end portions of said glass strips, said fastening elements guiding said glass strips along said rail, the improvement wherein each of said fastening elements includes a roller holding recess having opposite surfaces and an opening, cylindrical bores provided in said opposite surfaces, a roller having a shaft rotatably supported in said cylindrical bores, said guide passages each extending from a cylindrical bore to said opening and having a narrow section, the width of said narrow section being smaller than the diameter of said shaft, whereby the shaft of said roller is press-fit through said guide passage into said cylindrical bores so as to rotatably support said roller in said roller holding recess.

* * * * *